US005281156A

United States Patent [19]

Yi

[11] Patent Number: 5,281,156

[45] Date of Patent: Jan. 25, 1994

[54] SAFETY ELECTRICAL RECEPTACLE

[76] Inventor: Lee M. Yi, P.O. Box 82-144, Taipei, Taiwan

[21] Appl. No.: 19,453

[22] Filed: Feb. 18, 1993

[51] Int. Cl.[5] ..... H01R 13/44

[52] U.S. Cl. ..... 439/137; 439/145

[58] Field of Search ..... 439/137, 142, 143, 145

[56] References Cited

U.S. PATENT DOCUMENTS

| | | | |
|---|---|---|---|
| 3,222,631 | 12/1965 | Cohen | 439/137 |
| 3,238,492 | 3/1966 | Houston | 439/137 |
| 4,379,607 | 4/1983 | Bowden, Jr. | 439/137 |
| 4,544,219 | 10/1985 | Barkas | 439/137 |
| 5,006,075 | 4/1991 | Bowden, Jr. | 439/137 |

FOREIGN PATENT DOCUMENTS

| | | | |
|---|---|---|---|
| 2710915 | 9/1978 | Fed. Rep. of Germany | 439/137 |

*Primary Examiner*—Paula A. Bradley

*Attorney, Agent, or Firm*—Alfred Lei

[57] ABSTRACT

This invention relates to a safety electrical receptacle and in particular to one including a lower casing, an upper casing engaged with the lower casing having two slots for receiving two prongs of a plug, a sealing mechanism mounted within the upper casing and including two stoppers, a retractable frame on which are mounted the two stoppers, and two springs, each of the two stoppers being urged by a corresponding one of the two springs to go inwards thereby sealing the slots of the upper casing, the stoppers being engaged with the retractable frame so that the retractable frame will be retracted inwards when the stoppers are urged to go inwards, and a positioning member fitted on the retractable frame and the stoppers for enabling the retractable frame and the stoppers to move horizontally only, whereby the receptacle may prevent the children from getting an electric shock accidentally.

1 Claim, 6 Drawing Sheets

SAFETY ELECTRICAL RECEPTACLE

BACKGROUND OF THE INVENTION

It has been found that the conventional electrical receptacle mainly comprises an upper casing and a lower casing which are joined together by a screw extending through the threaded hole of the upper casing and the threaded hole of the lower casing. The upper casing is provided with two slots on the top for adapting to receive the prongs of a plug. However, the upper casing does not have any sealing means so that the children may insert metal pins into the receptacle and get an electric shock accidentally.

Therefore, it is an object of the present invention to provide a safety electrical receptacle which may obviate and mitigate the above-mentioned drawbacks.

SUMMARY OF THE INVENTION

This invention relates to an improved safety electrical receptacle.

It is the primary object of the present invention to provide a safety electrical receptacle which may prevent the children from getting an electric shock accidentally.

It is another object of the present invention to provide a safety electrical receptacle which may firmly engage with a plug.

It is still another object of the present invention to provide a safety electrical receptacle which is safe in use.

It is still another object of the present invention to provide a safety electrical receptacle which is economic to produce.

It is a further object of the present invention to provide a safety electrical receptacle which is simple in construction.

Other objects and merits and a fuller understanding of the present invention will be obtained by those having ordinary skill in the art when the following detailed description of the preferred embodiment is read in conjunction with the accompanying drawings.

DETAILED DESCRIPTION OF THE PREFERRED EMBODIMENT

Before explaining the present invention in detail, it is to be understood that the invention is not limited in its application to the details of construction and arrangement of parts illustrated in the accompanying drawings, since the invention is capable of other embodiments and of being practiced or carried out in various ways. Also it is to be understood that the phraseology or terminology employed herein is for the purpose of description and not of limitation.

Figure 1:
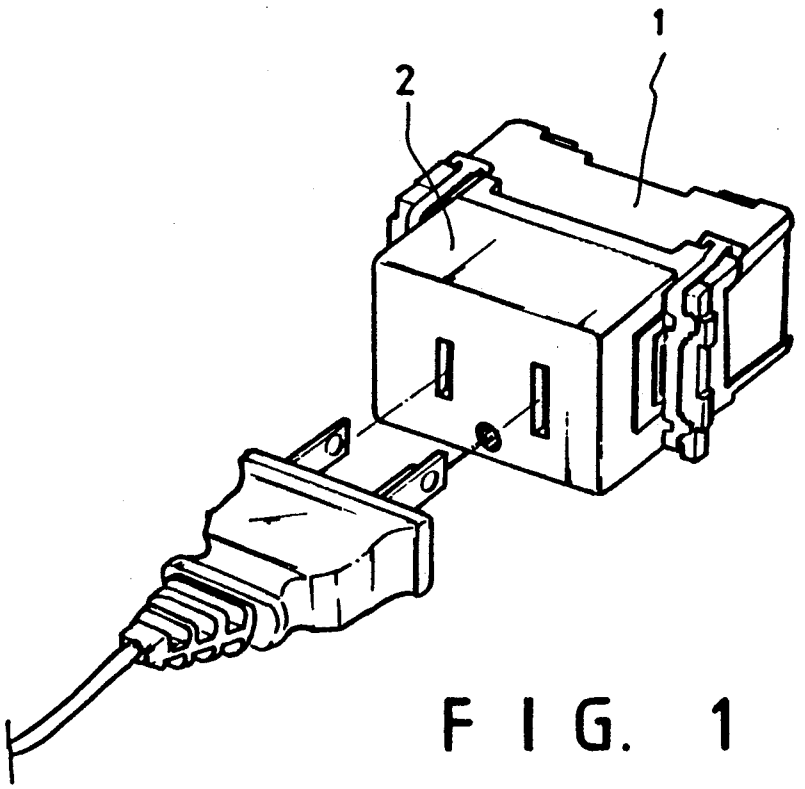
FIG. 1 is a perspective view of a safety electrical receptacle according to the present invention.
Figure 2:
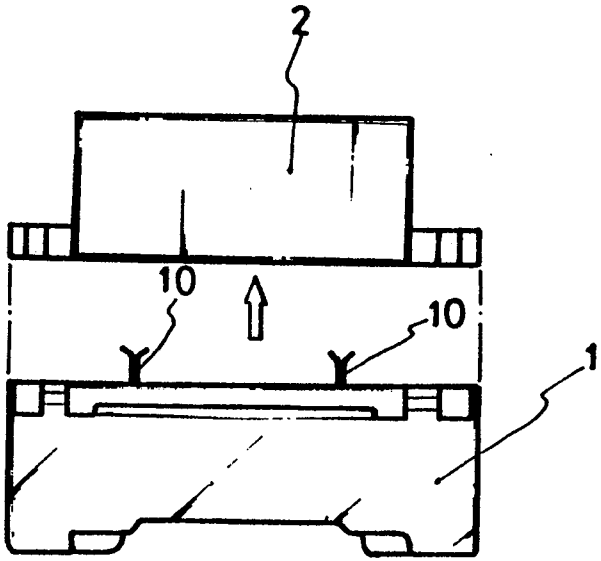
FIG. 2 shows the side view of the upper casing and the lower casing of the safety electrical receptacle.
Figure 3:
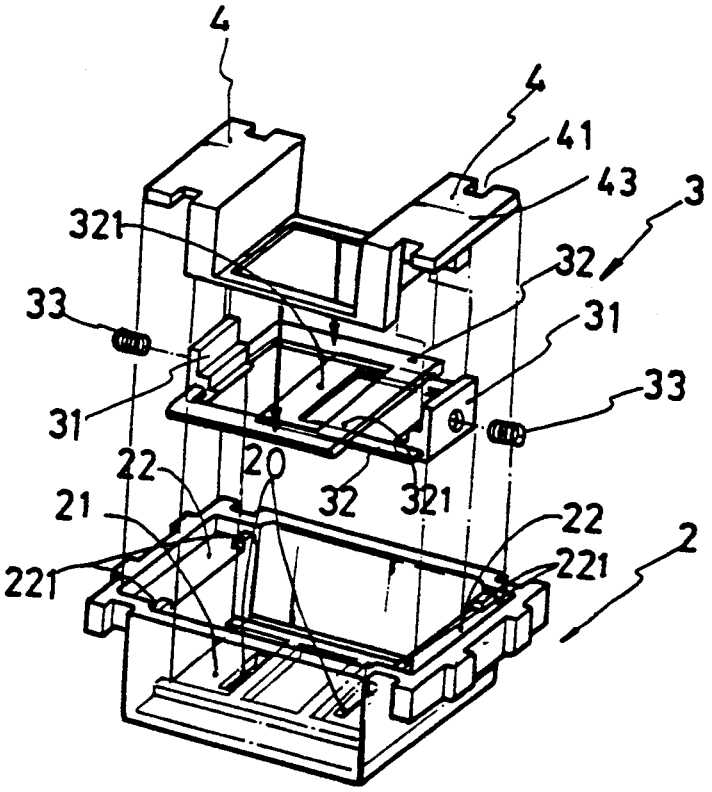
FIG. 3 is an exploded view of the upper casing.

With reference to the drawings and in particular to FIGS. 1, 2 and 3 thereof, the safety electrical receptacle according to the present invention mainly comprises a lower casing 1, an upper casing 2, a sealing mechanism 3, and a positioning member 4. The lower casing 1 is engaged with the upper casing 2 by known means. The upper casing 2 is provided with three slots for receiving the prongs of a plug.

As shown in FIG. 2, the sealing mechanism 3 is disposed within the upper casing 2 and includes two stoppers 31, a retractable frame 32 on which are mounted the two stoppers 31, and two springs 33. The retractable frame 32 is mounted on the recess 21 on the inside bottom of the upper casing 2. The retractable frame 32 is composed of a first member and a second member slidably engaged the first member. Both stoppers 31 are urged by a corresponding spring 33 to go inwards thereby sealing the slots 20 of the upper casing 2. As the stoppers 31 are engaged with the retractable frame 32, the retractable frame 32 will be retracted inwards when the stoppers 31 are urged to go inwards.

Figure 4A:
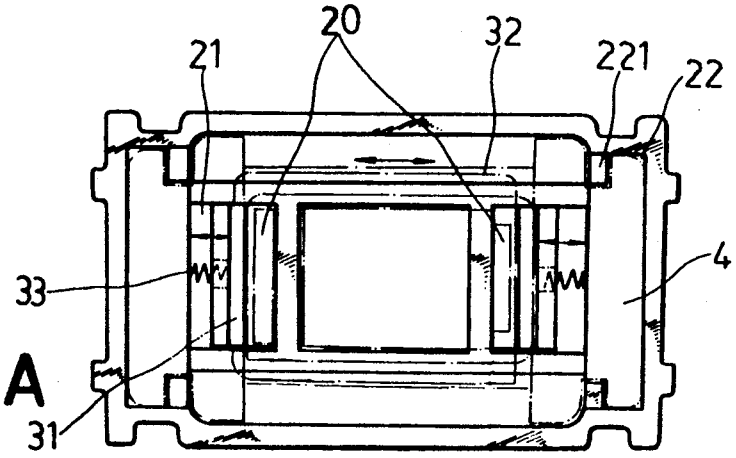
FIG. 4A is a top view of the upper casing.
Figure 4B:
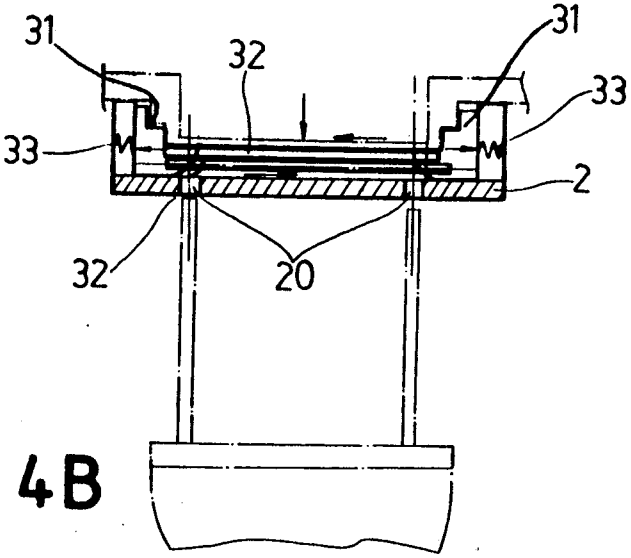
FIG. 4B is a sectional view showing the principle of the retractable frame.
Figure 6A:
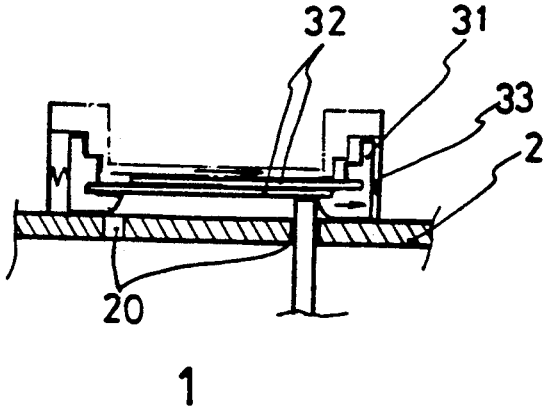
FIGS. 6A and 6B show the working principle of the present invention.
Figure 6B:
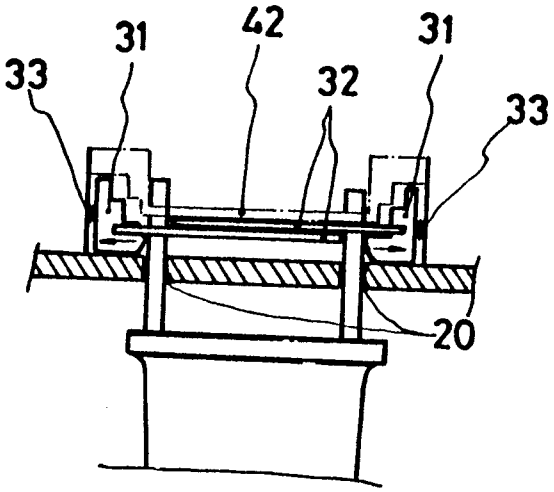

Referring to FIGS. 3 and 4, the retractable frame 32 is provided with an edge 321 at both sides so as to seal the slots 20 of the upper casing 2 normally.

Figure 5B:
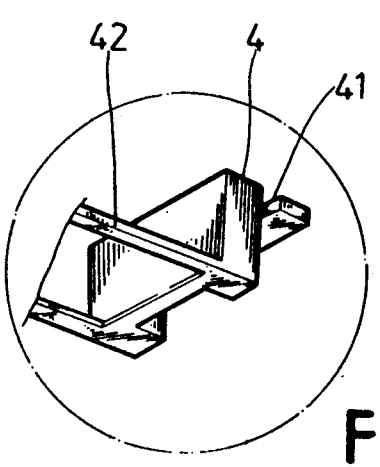
FIG. 5B is an enlarged fragmentary view of the retractable frame.
Figure 5A:
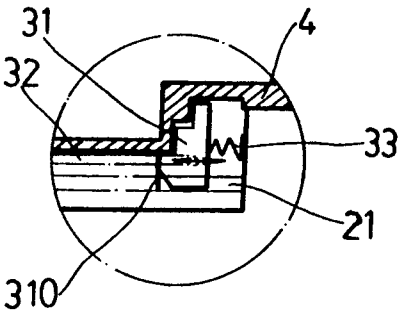
FIG. 5A is an enlarged fragmentary view showing the connection between the stopper and the retractable frame.

Looking now at FIG. 5, the stopper 31 is formed with an inclined surface 310 so that when the prong of a plug (not shown) is inserted into the upper casing 2, the prong of the plug will force the stopper 31 to go outwards thereby opening the slot 20 of the upper casing 2. Further, the positioning member 4 has a rectangular frame and a press plate 42 at both ends thereof. The positioning member 4 is fitted on the retractable frame 32 and the stoppers 31, with its two wings 43 received in the recesses 22 of the upper casing 2 and its notches 41 engaged with the protuberances 221 of the upper casing 2. Hence, the retractable frame 32 and the stoppers 31 can only move along a horizontal plane.

As a pin or the like (not shown) is inserted into the a slot 20 of the upper casing 2, then the retractable frame 32 will retract to one side only and the other slot 20 of the upper casing 2 will remain closed. When a plug (not shown) is inserted into the slots 20 of the upper casing 2, the retractable frame 32 will move inwards thereby opening two slots 20 of the upper casing 2 and therefore enabling the plug to engage with the upper casing 2.

The invention is naturally not limited in any sense to the particular features specified in the forgoing or to the details of the particular embodiment which has been chosen in order to illustrate the invention.

Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A safety electrical receptacle comprising:

a lower casing;

an upper casing engaged with said lower casing having two slots for receiving two prongs of a plug;

a sealing mechanism mounted within said upper casing and including two stoppers, a retractable frame on which are mounted the two stoppers, and two springs, each of said two stoppers being urged by a corresponding one of said two springs to go inwards thereby sealing the slots of said upper casing, said stoppers being engaged with said retractable frame so that said retractable frame will be retracted inwards when said stoppers are urged to go inwards; and a positioning member fitted on said retractable frame and said stoppers for enabling said retractable frame and said stoppers to move horizontally only.

* * * * *